US005724906A

United States Patent [19]

Lee

[11] Patent Number: 5,724,906

[45] Date of Patent: Mar. 10, 1998

[54] WIND RESISTANCE REDUCING STRUCTURE OF A SHIP

[76] Inventor: Kwang-Chang Lee, 4F. No. 1-3, ChungHsiao St., Chung Ho City, Taipei, Taiwan

[21] Appl. No.: 787,378

[22] Filed: Jan. 22, 1997

[51] Int. Cl.[6] ..... B63B 29/02

[52] U.S. Cl. ..... 114/71; 440/8

[58] Field of Search ..... 114/65 R, 71; 440/8, 37

[56] References Cited

U.S. PATENT DOCUMENTS

| | | | |
|---|---|---|---|
| 1,491,688 | 4/1924 | Ford | 440/8 |
| 1,986,064 | 1/1935 | Leray | 440/37 |
| 4,324,985 | 4/1982 | Oman | 440/8 |

FOREIGN PATENT DOCUMENTS

| | | | |
|---|---|---|---|
| 144190 | 9/1982 | Japan | 440/8 |

*Primary Examiner*—Stephen Avila

*Attorney, Agent, or Firm*—Jacobson, Price, Holman & Stern, PLLC

[57] ABSTRACT

A wind resistance reducing structure including a wind tunnel made longitudinally through a navigating bridge superstructure of a ship for example a tanker or bulk freighter, and two gates respectively controlled to open the two opposite ends of the wind tunnel when the ship is navigated against the wind, or to close the two opposite ends of the wind tunnel when the ship is navigated with the wind.

2 Claims, 5 Drawing Sheets

WIND RESISTANCE REDUCING STRUCTURE OF A SHIP

BACKGROUND OF THE INVENTION

The present invention relates to a wind resistance reducing structure for a ship, and more particularly to such a wind resistance reducing structure which greatly reduces the wind resistance when the ship is navigated against the wind.

Regular ships are commonly made having a shape that offers the least possible resistance to the air and water. However, because the navigating bridge superstructure of a ship, for example a tanker or bulk freighter, is raised from the deck, it offers a high resistance to the air when the ship is navigated against the wind, causing the ship to consume much fuel oil.

SUMMARY OF THE INVENTION

According to one aspect of the present invention, a wind tunnel is made longitudinally through the navigating bridge superstructure of the ship, and two gates are installed in the navigating bridge superstructure and controlled to close/open the two opposite ends of the wind tunnel. When the ship is navigated against the wind, the wind tunnel is opened for letting wind currents to pass, therefore the wind resistance against the ship is reduced, and the consumption of fuel oil of the ship can be minimized. According to another aspect of the present invention, a wind driven generator may be installed in the wind tunnel to utilize wind force for generating electricity.

DETAILED DESCRIPTION OF THE PREFERRED EMBODIMENT

Figure 1:
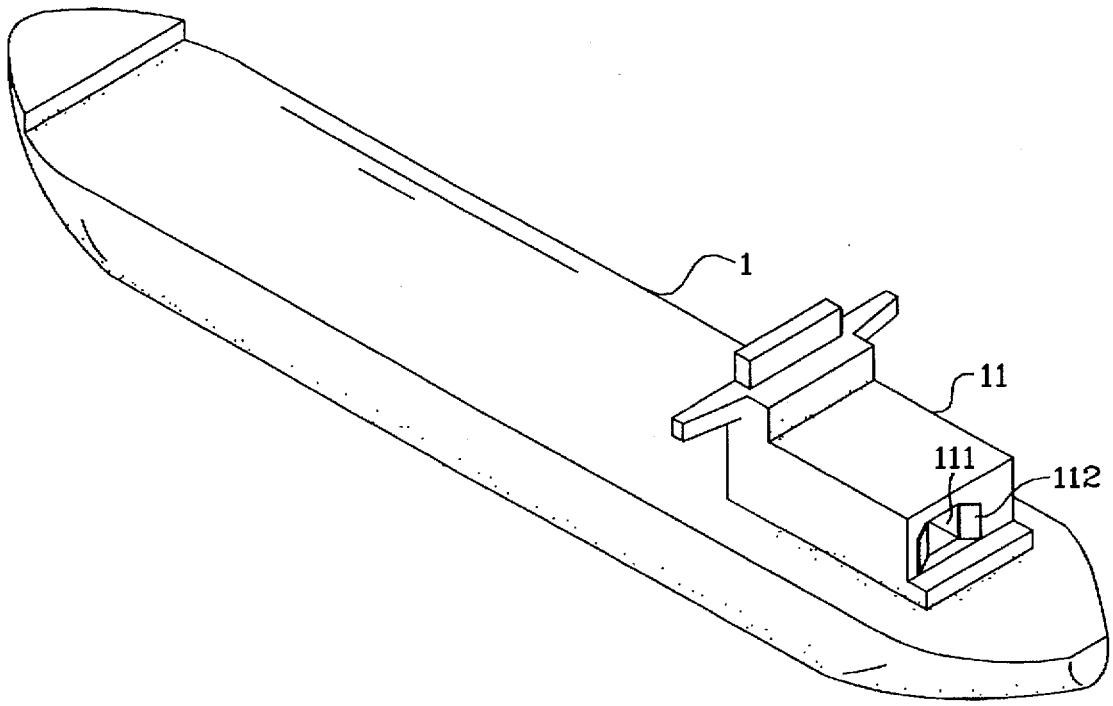
FIG. 1 is an elevational view of a wind resistance reducing structure according to the present invention.
Figure 2:
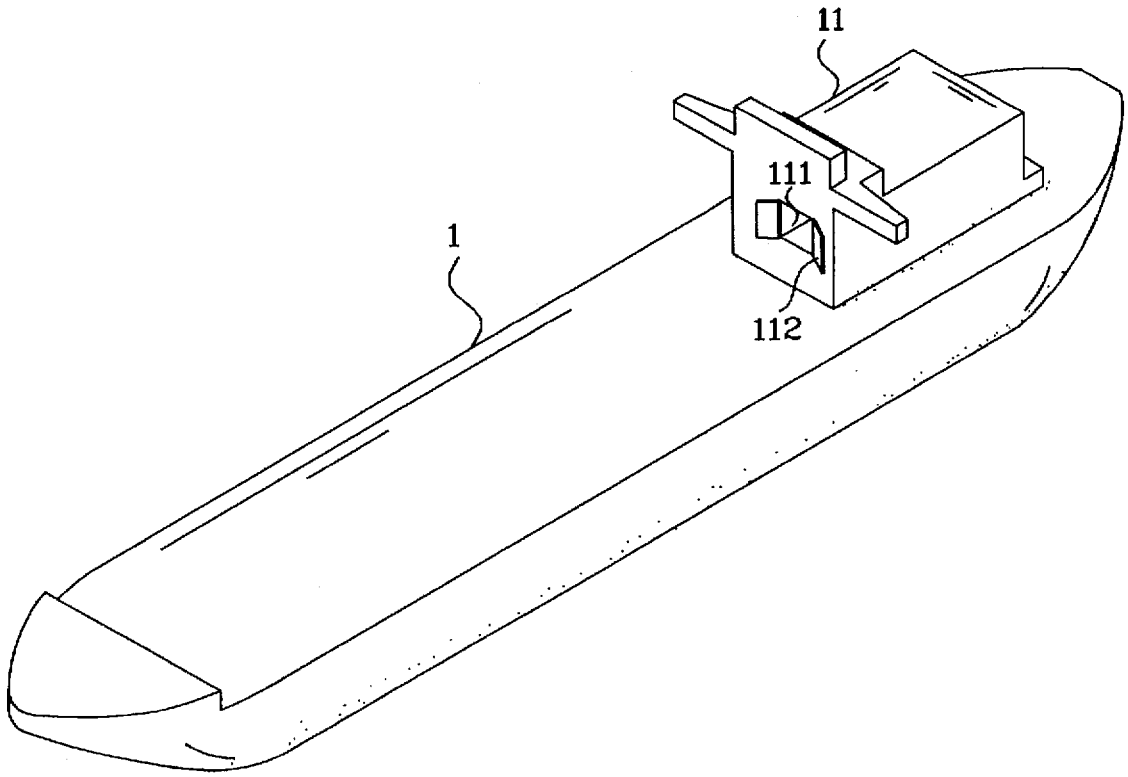
FIG. 2 is an another elevational view of a wind resistance reducing structure according to the present invention.
Figure 3:
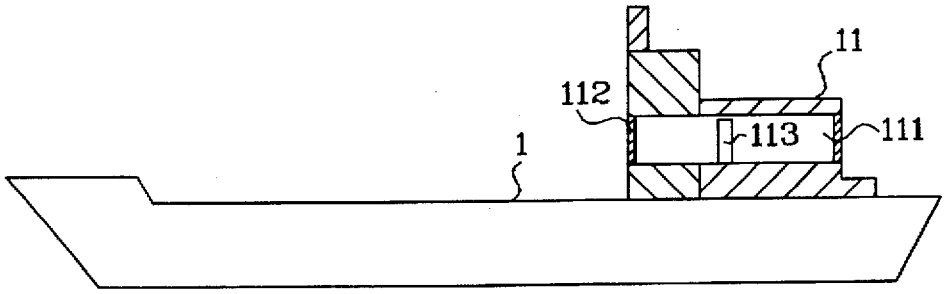
FIG. 3 is a sectional view of the wind resistance reducing structure shown in FIG. 1.

Referring to FIGS. 1,2 and 3 a wind tunnel 111 is made through a navigating bridge superstructure 11 of a ship 1. Two gates 112 are installed in the navigating bridge superstructure 11, and controlled to close/open the two opposite ends of the wind tunnel 111. A wind driven generator 113 is mounted inside the wind tunnel 111.

Figure 4:
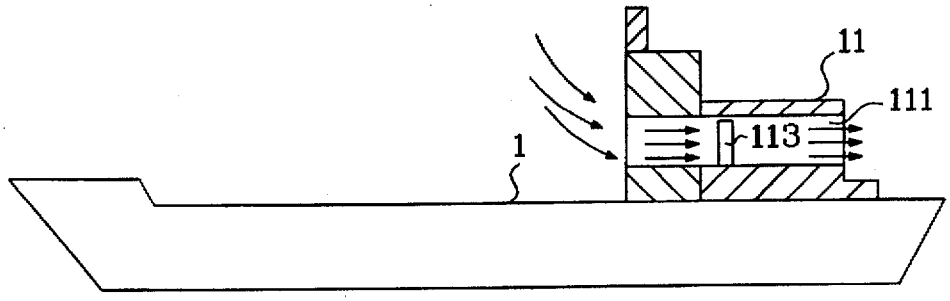
FIG. 4 shows the ship navigated against the wind, and wind currents passed through the wind tunnel according to the present invention.

Referring to FIG. 4, when the ship 1 is navigated against the wind, the gates 112 are opened, permitting wind currents to pass through the wind tunnel 111. When wind currents pass through the wind tunnel 111, less wind resistance is produced against the navigation of the ship 1, and at the same time the wind driven generator 113 is driven by wind force to generate electricity.

Figure 5:
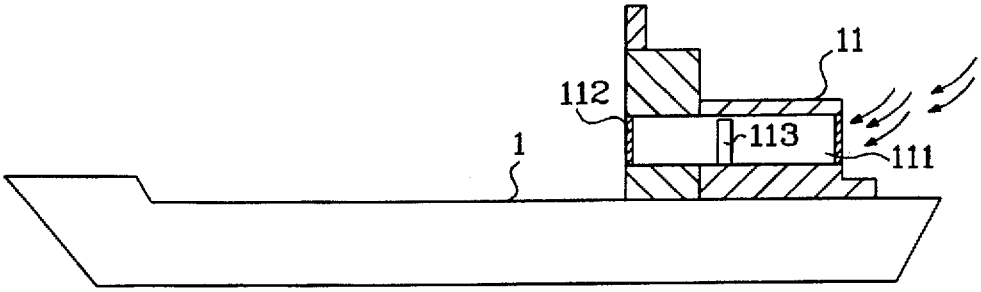
FIG. 5 shows the ship navigated with the wind, and the wind tunnel closed according to the present invention.

Referring to FIG. 5, when the ship 1 is navigated with the wind or under a bad weather, the gates 112 are closed to stop wind currents from passing through the wind tunnel 111.

As stated above, the design of the wind tunnel 111 greatly reduces the wind resistance, improves the velocity of navigation, and saves the consumption of fuel oil. Furthermore, the wind tunnel 111 concentrates wind force for driving the wind driven generator 113 for generating electricity.

What the invention claimed is:

1. A wind structure comprising a navigating bridge superstructure of a ship defined between two spaced walls, a wind tunnel extending between said two spaced walls and having a gate movably mounted at each of said two spaced walls to define opposed ends of said wind tunnel and said two gates being selectively controlled to open and close the opposed ends of said wind tunnel so as to allow wind currents to pass through said wind tunnel through the open gates When the ship is navigated against the wind and to navigate the ship with the wind when the gates are closed.

2. The wind structure of claim 1, further comprising a wind driven generator installed in said wind tunnel between the two spaced walls.

* * * * *